US006806841B2

(12) United States Patent
Nilsson et al.

(10) Patent No.: US 6,806,841 B2
(45) Date of Patent: Oct. 19, 2004

(54) TRI-ELEMENT ANTENNA WITH DISH

(76) Inventors: Jack Nilsson, 699 Braddock's Landing, Medina, OH (US) 44256; H. Gregory Badger, 16331 Heather La., Middleburg Heights, OH (US) 44130

( * ) Notice: Subject to any disclaimer, the term of this patent is extended or adjusted under 35 U.S.C. 154(b) by 0 days.

(21) Appl. No.: 10/294,420

(22) Filed: Nov. 14, 2002

(65) Prior Publication Data

US 2003/0122719 A1 Jul. 3, 2003

Related U.S. Application Data

(63) Continuation-in-part of application No. 09/803,245, filed on Mar. 9, 2001, now Pat. No. 6,496,152.
(60) Provisional application No. 60/368,356, filed on Mar. 28, 2002.

(51) Int. Cl.[7] ..... H01Q 9/28
(52) U.S. Cl. ..... 343/773; 343/791
(58) Field of Search ..... 343/791, 792, 343/773, 765, 882, 713, 711, 901, 900, 715, 797, 807, 835, 833, 824

(56) References Cited

U.S. PATENT DOCUMENTS

| | | | | |
|---|---|---|---|---|
| 4,633,265 A | * | 12/1986 | Wheeler | 343/797 |
| 5,212,493 A | * | 5/1993 | Cluniat et al. | 343/765 |
| 6,127,987 A | * | 10/2000 | Maruyama et al. | 343/835 |
| 6,300,912 B1 | * | 10/2001 | Pla | 343/713 |
| 6,496,152 B2 | * | 12/2002 | Nilsson | 343/713 |

* cited by examiner

*Primary Examiner*—James Vannucci
(74) *Attorney, Agent, or Firm*—The Weintraub Group, PLC

(57) ABSTRACT

A three element antenna utilizes a truncated parabolic reflector dish of diameter "d" and focal point "f" and a director plate for receiving and transmitting high frequency signals in conjunction with a substantially horizontal conducting ground plane. The antenna is mounted to a planar transverse end wall, defining the lower truncated end of the parabolic surface, and the antenna elements are proximate to the focal point "f" of the paraboloid that defines the dish. The director plate is positioned at the opening (defining the diameter "d"), is distal to the focal point and the antenna elements, and positions an array of director rods about the antenna elements to focus signals relative to the parabolic surface. The ratio of (f/d) is about 0.01 to about 0.625, and preferably about 0.210.

32 Claims, 5 Drawing Sheets

FIG 1
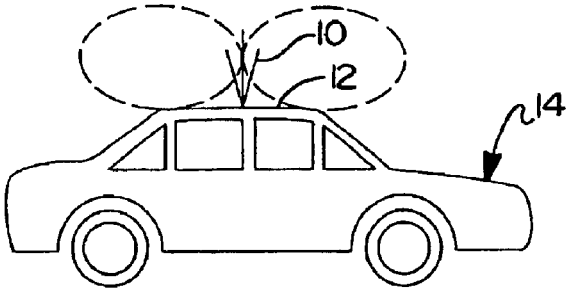
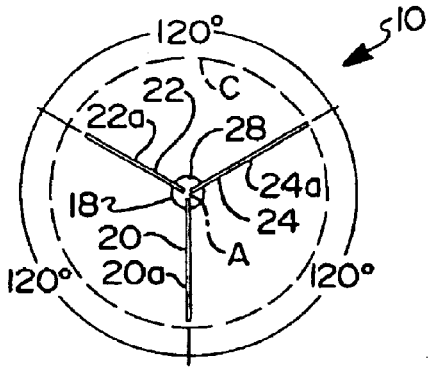
FIG 2
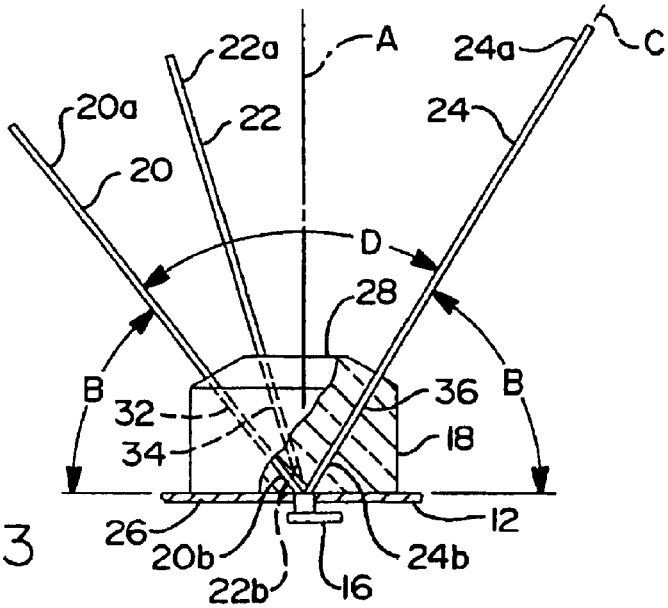
FIG 3

FIG 6A
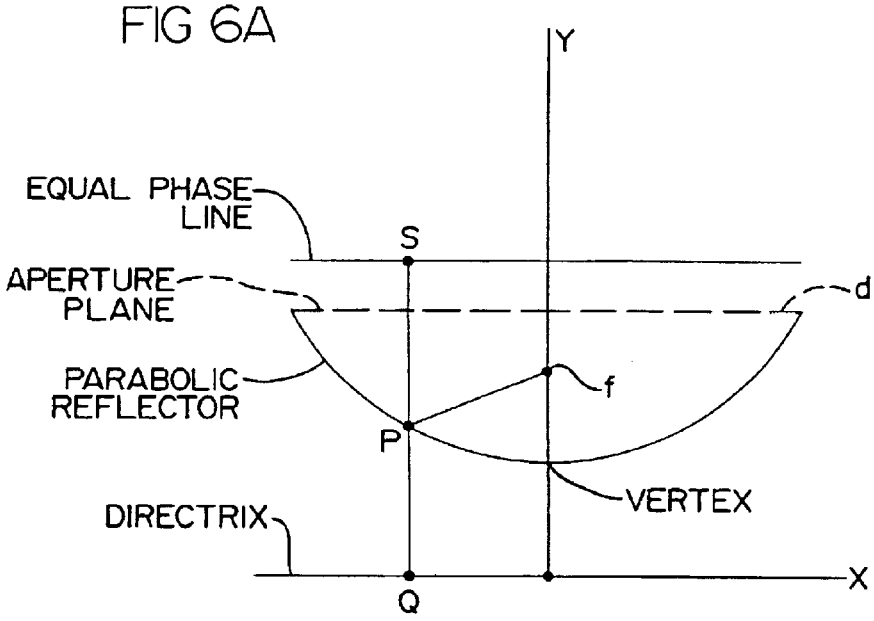
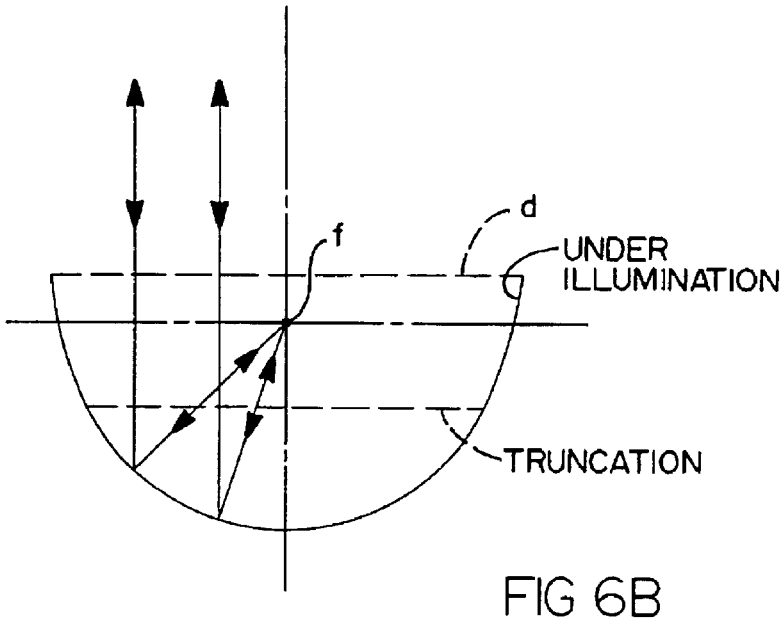
FIG 6B

FIG 8
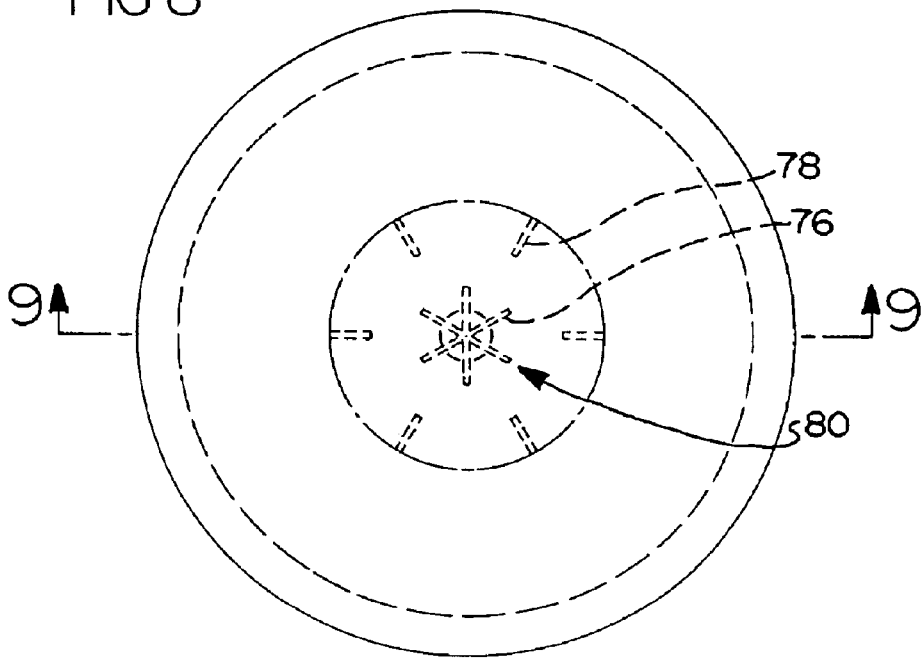
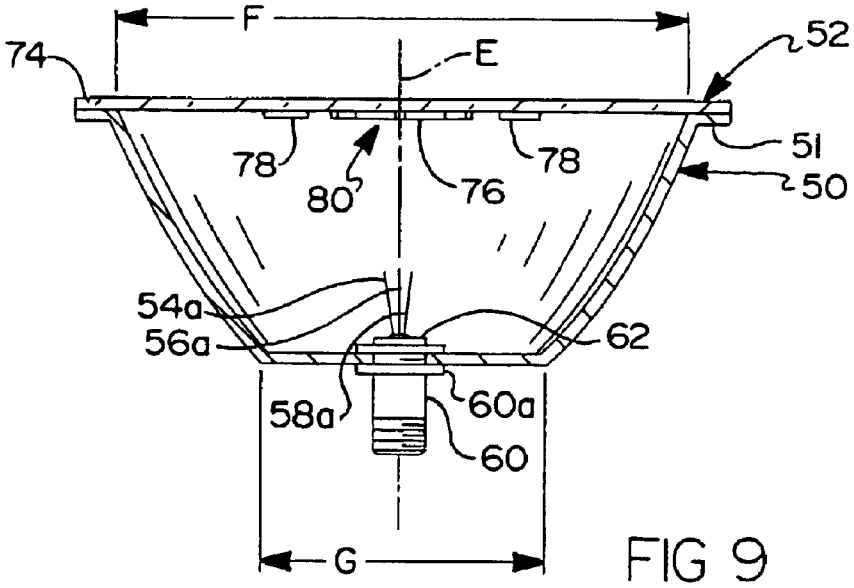
FIG 9

TRI-ELEMENT ANTENNA WITH DISH

CROSS REFERENCE TO RELATED APPLICATIONS

This is a Continuation-in-part of patent application Ser. No. 09/803,245, filed Mar. 9, 2001, now U.S. Pat. No. 6,496,152, for "Dual Polarized Antenna", and a Completion Patent Application of co-pending U.S. Provisional Patent Application Serial No. 60/368,356, filed on Mar. 28, 2002, for "Tri-Element Antenna With Dish", the disclosures of each hereby incorporated by reference.

BACKGROUND OF THE INVENTION

1. Field of the Invention

This invention relates to mobile and base station antennas and more particularly to a dual polarized tri-element (tri-band) antenna for use in vehicles. In a particular aspect, the antenna is used with a parabolic dish reflector and director elements to provide for high gain applications.

2. Description of Related Art

Currently there is a growing need for wireless mobile telephones. Common places on a vehicle for mounting mobile antennas include the roof, rain gutter, bumper, trunk lid, mirror bracket, fender and the side of the vehicle. The simplest mobile VHF/UHF antenna is the quarter wave vertical "whip" antenna mounted on a high-grade standoff insulator on the roof of a car. The metal body of the vehicle serves as a ground plane but can distort the normal circular radiation pattern of a vertical antenna.

At the center frequency of the citizen's band (27.185 MHz) a quarter wave antenna is 108.62 inches (about 10 feet). Such an antenna can strike many overhead obstructions, causing it to bend and alter the angle of radiation when the vehicle is moving. Mounting a 10-foot antenna on the roof of a car is not feasible. An antenna that is physically shorter than a quarter wavelength must have inserted into it a suitable loading coil to bring its electrical length up to a quarter wave.

The performance of a mobile whip antenna can be improved by adding capacitance to the portion of the antenna above the loading coil. This capacitance tends to resonate with the inductance of the coil. Since the impedance of the whip antenna is lower than that of the coaxial line that brings power from the transmitter, an impedance matching network is needed.

Additionally, in general, an antenna must be tuned to the same frequency band that the radio system to which it is connected operates in; otherwise, transmission and/or reception can be impaired. For the strongest signals, the transmitting and receiving signals each should have the same polarization, either horizontal or vertical. Oftentimes communication must be between stations that use vertical polarization and horizontal polarization. Reflections/refractions due to buildings/land masses cause cross-polarization of signals. Polarization of satellite signals is circular.

Franz U.S. Pat. No. 2,218,707 (issued October, 1940) discloses a dual polarization or dipole antenna for receiving and transmitting high frequency signals in conjunction with a substantially horizontal conducting vehicle panel defining a ground plane. In this antenna, three radiative elements are arranged vertically with two reflective radiators being mounted in vertical symmetrical relationship to a central radiator. The radiative elements do not have like ends secured in a common point or apex of a cone. Franz does not specifically teach specific frequency bands, or insulating the antenna elements from the vehicle ground, such as by a mounting block comprised of a dielectric material.

It is a general object of this invention to provide an improved multi-band antenna which is horizontally and vertically polarized and effective to transmit and receive in the broad frequency bands 140–170 MHz, 200–225 MHz and 400–480 MHz to include land mobile, HAM and satellite uses.

Another object of this invention is the provision of a mobile antenna that is compact and of low height, which permits mounting on the top of a vehicle.

Still another object of this invention is the provision of an antenna that does not require lossy band restrictive coils or windings (to bring the electrical length of the antenna up to a requisite wavelength) or tuning capacitors, thus providing an increase in signal strength.

Yet another object of this invention is the provision of a multi-element antenna system that significantly reduces flutter (picket-fencing) in the signal.

In another aspect of this invention, an object is the provision of a dual polarized antenna system used with a parabolic dish reflector to provide for high gain applications.

According to this latter aspect, an object is to associate an array of director rods, at the aperture plane of a parabolic dish reflector, to enhance the signal gain and directivity of signals sent to or received from a tri-element antenna positioned at the focal point below the aperture plane of the paraboloid.

SUMMARY OF THE INVENTION

In accordance with the present invention there is provided a dual polarization antenna for receiving and transmitting high frequency (VHF/UHF) signals in conjunction with a substantially horizontal conducting vehicle panel defining a ground plane, said dual polarization antenna comprising:

a first, second and third radiative element each comprised of an electrically conductive material, each said radiative element being generally linear and extending between a proximal end and a distal end, and means mountable of the vehicle panel for securing the proximal ends together at a common point and in electrical circuit relation with one another for connection to a vehicle transceiver, the radiative elements extending vertically upwardly and outwardly from said common point whereby to form an imaginary cone with the proximal ends forming the apex of the cone, said radiative elements each being of a different length and disposed at an angle relative to the ground plane to provide horizontal and vertical polarization and jointly resonate in a first, second and third frequency band.

In a preferred embodiment, the motor vehicle defines an electrical ground potential and the antenna is electrically insulated from said motor vehicle ground potential. The geometric axis of the cone is perpendicular to the ground plane and the radiative elements forming the cone are disposed at an angle of about 20° to 45° relative to the geometric axis of the cone (i.e., the cone has an angle of about 40° to 90° and is symmetrically aligned with the geometric axis). The radiative elements have a length of about 16 and 19 inches and the distal ends, if equal-lengthed, are circumferentially spaced at 120° relative to the base of the imaginary cone.

Preferably, the radiative elements forming the cone are disposed at an angle of about 60° to the ground plane and resonate in the frequency bands of about 140–170 MHz, 200–225 MHz and 400–480 MHz; and the length of the first, second and third radiative element is, respectively, about 16 ¾ inches, 18 ½ inches and 19 inches. In another preferred embodiment, the elements of the cone have respective lengths of about 16 inches, 17 ¾ inches, and 18¼ inches long.

Advantageously, an antenna having the above construction eliminates "lossy" coils, capacitors and matching structures and has high power handling capabilities (200+ watts); achieves transceiving efficiency/gain in multiple frequency bands; provides broad frequency in each frequency band; reduces null/flutter problems; provides effective "dual" polarization radiation away from the horizon in addition to efficient "near" horizon pattern; and provides extremely wide efficient continuous frequency receiving capabilities in a simple but compact construction.

According to another aspect of this invention is provided a dual polarization antenna for receiving and transmitting high frequency signals in conjunction with a substantially horizontal conducting panel defining a ground plane. According to this aspect, the dual polarization antenna comprises:

an electrically conductive first, second and third antenna element to receive horizontally and vertically polarized components and jointly resonate within three separate frequency bands, each said antenna element being axially elongated and having a first end and a second end, and a mounting block comprised of a dielectric material adapted to be mounted to the vehicle panel, said mounting block electrically insulating said first, second and third antenna elements from the vehicle ground plane and securing said antenna elements into a triangular arrangement such that said second ends are in electrical circuit path relation with one another and the first ends are spaced vertically upwardly and above said mounting block and circumferentially spaced at 120°, the antenna elements forming an imaginary cone having a center geometrical axis that is generally perpendicular to the ground plane of the vehicle.

Preferably, the antenna elements are disposed at predetermined angle relative to the ground plane to provide horizontal and vertical polarization in the first, second, and third frequency bands.

According to yet another important aspect of this invention, an antenna comprises three radiative elements for transmitting and receiving electromagnetic radiation within predetermined frequency bands, the radiative elements being electrically connected at common point at one end of a radiative member and forming an imaginary cone. Further, this antenna comprises:

a truncated parabolic reflector dish, said reflector dish having a parabolic surface portion conforming to a paraboloid of revolution about a central geometric axis, a focal point on the axis, a rearward end wall, and a forward end portion, and first means for mounting the radiative member on said parabolic dish and positioning said radiative elements relative to said axis and substantially at said focal point.

The reflector dish has an opening defined by a diameter "d" and the focal point "f" of the parabolic dish is located on the central geometric axis of the parabola. The reflector dish may be shallow or deep, depending on the application. Preferably, the focal point is between the vertex of the parabola and the opening of the dish. Preferably, the antenna has a ratio of "f/d" of about 0.01 to about 0.625. More preferably, the ratio of "f/d" is about 0.21.

Inasmuch as the radiative elements are axially elongated, the elements are not located, as a point source, at the focal point of the parabola. Preferably, the midpoint of the axially elongated radiative elements is located substantially at the focal point of the reflective dish. Further, the radiative elements may be of the same or different length.

In an additional preferred aspect, the antenna further comprises: second means for supporting and positioning a plurality of conductive director rods in spaced overlying relation to said radiative member, said director rods being substantially coplanar and disposed in a plane orthogonal to said axis and spaced away from said end wall and said focal point.

In this regard, the second means preferably comprises a generally planar support member that is connected to the opening of said reflector dish, and the director rods are connected to said support member and positioned above the radiative elements. Preferably, the support member is comprised of a material substantially transparent to electromagnetic energy.

In this additional preferred aspect, the director rods are disposed on a radius extending outwardly from the axis of the reflector dish and arranged in a first and second sets. The first set of rods forms the spokes of a wagon wheel (or a "star") that is centered on the axis, each of the rods (spokes) of the first set being generally at 60° to one another. The second set of rods is disposed within an annular band that encircles the wagon-wheel, the annular band being centered on the axis and the director rods being generally at 60° to one another. The director rods of the first and second sets are angularly offset at about 30° to one another.

The novel features of this invention are set forth with particularity in the appended claims. The invention itself will be best understood from the following description when read in connection with the accompanying drawings.

BRIEF DESCRIPTION OF THE DRAWINGS

FIG. 1 is a perspective view of an antenna according to the present invention shown mounted to a vehicle.

FIG. 2 is a top plan view of the antenna.

FIG. 3 is a side elevation view of the antenna.

FIGS. 6A and 6B are diagrammatical views of a parabola as relates to a parabolic reflector dish, according to another embodiment of this invention.

FIG. 8 is a top plan view of the three-element antenna of FIG. 6 as assembled.

FIG. 9 is a side elevation section view of the three-element antenna taken along line 9—9 of FIG. 8.

DETAILED DESCRIPTION OF A PREFERRED EMBODIMENT

Figure 4:
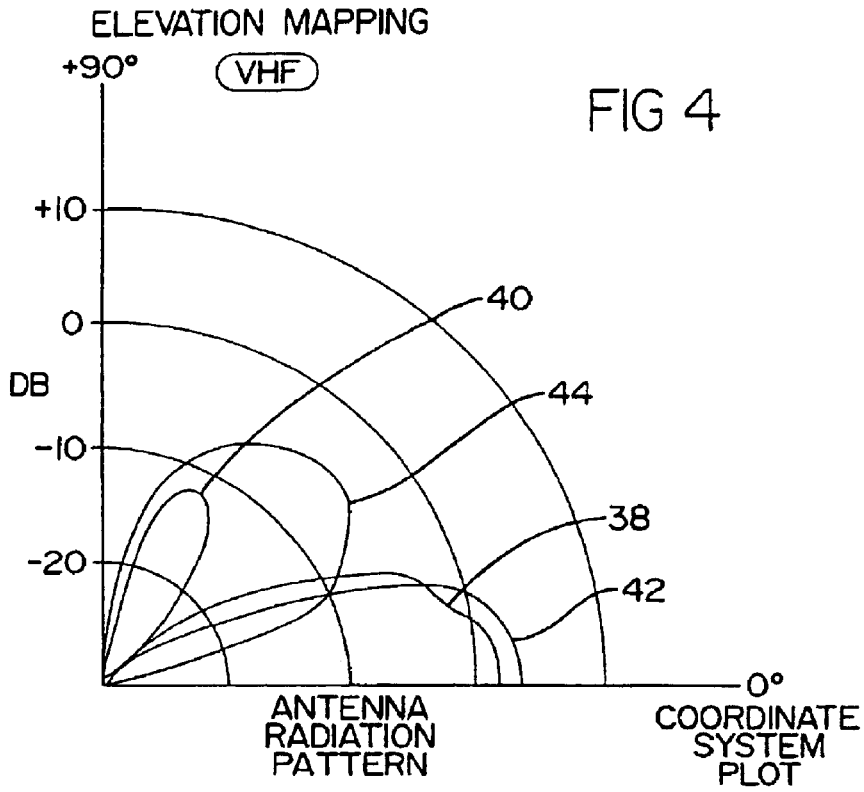
FIG. 4 is a graph comparing the VHF radiation pattern of a ⅝-wave antenna and an antenna according to the present invention.

The present invention relates to a dipole ground plane antenna for motor vehicles. The antenna may be adapted for use with a multitude of receiving systems such as those used for mobile communications, FM radio, AM radio, passive systems and the like. The antenna provides excellent directional properties, provides broader bandwidth and smoother radiation patterns than antennas of the prior art, and provides substantially easier impedance matching with a selected receiver.

Turning to FIGS. 1–3, a ground plane antenna 10 of the present invention is particularly suited for motor vehicle applications and is shown mounted to the roof 12 of a motor vehicle 14 and in electrical circuit relation with a transceiver or receiving device 16 of the motor vehicle. The antenna 10 may be installed in almost any motor vehicle such as an automobile, truck, train, or construction equipment and the like. Further, although the antenna is shown secured to the roof of an automobile, the antenna could be mounted elsewhere.

When installed into the motor vehicle 14, the motor vehicle itself will define an electrical ground potential. However, in the present invention, the antenna is electrically insulated from the motor vehicle ground potential. In other words, the antenna itself is not grounded in the present invention. Rather, the antenna is grounded through the ground of the receiving device 16 to which the antenna is connected.

The antenna 10 comprises a mounting block 18, a first radiative antenna element 20, a second radiative antenna element 22, and a third radiative antenna element 24. The radiative antenna elements 20, 22, and 24 are in the form of a wire, rod, tube or the like and extend linearly between a proximal end 20*b*, 22*b*, and 24*b* and a distal end 20*a*, 22*a*, and 24*a*. The radiative antenna elements are comprised of an electrically conductive material and, depending on the frequencies and allowable losses, can be manufactured from a metal coated plastic (or vice versa), copper, brass, aluminum or steel or other conductive materials known to those skilled in the art. Preferably, the radiative antenna elements are comprised of a stainless steel to provide good electrical conductivity as well as resistance to changes in the environment.

The mounting block 18 is comprised of a aluminum, stainless steel or other suitable electrically conductive material. A dielectric or other suitable electrically insulative material is inserted between the mounting block 18 and the roof 12. Preferably, the mounting block is of one-piece construction and formed to include a lower surface 26 for mounting on the insulative material, an upper surface 28, and a plurality of bores 32, 34, and 36. The bores extend between the lower and upper surfaces 26 and 28 and are configured to receive the proximal end portions of the respective radiative antenna elements 20, 22, and 24.

The bores 32, 34, and 36 are at a predetermined angle relative to the ground plane and position the respective proximal ends 20*b*, 22*b*, and 24*b* together at a common point and in electrical circuit relation with one another. So secured, the radiative elements extend vertically upwardly from the common point and outwardly from the upper surface 28 of the mounting block. Preferably, each radiative antenna element is secured in its respective bore by a fastener, such as a set screw, rivet, pin or bolt (not shown), or are threaded, as would then also be the bores.

The radiative antenna elements 20, 22, and 24 form an imaginary cone "C" with the center geometric axis "A" of the cone being disposed generally perpendicularly to the surface 26 and 12. The radiative antenna elements form the cone surface, wherein the proximal ends 20*b*, 22*b*, and 24*b* form the apex of the cone, and the distal ends 20*a*, 22*a*, and 24*a* project onto and are circumferentially spaced at 120° to one another to form a triangular arrangement.

Preferably, the radiative antenna elements of the cone "C" have a double included angle "D" of about 40° to 90° relative to the geometric axis of the cone. That is, the radiative antenna elements, forming the cone, are at an angle "B" of about 70° to 45° relative to the ground plane (or the mounting surface 28). In a more preferred arrangement, the radiative antenna elements are disposed at an angle "B" of about 60° to the ground plane.

Preferably, the radiative antenna elements 20, 22 and 24 provide horizontal and vertical polarization and are of a different length to jointly resonate more broadly within three frequency bands. According to this invention, the radiative elements 20, 22, and 24 are about 16 to 19 inches in length.

In one preferred embodiment, the radiative element 20 is about 16 ¾ inches long and primarily responsive to the higher portions of the three bands (140–170 MHz, 200–225 MHz and 400–480 MHz). The radiative antenna element 22 is about 18½ inches long and primarily responsive to the mid-portion of the three bands. The radiative antenna element 24 is about 19 inches long and primarily responsive to the lower portion of the three frequency bands. The antenna elements 20, 22, and 24 are selected to resonate at ¼ the wavelength of the lowest transceiving frequency. With interactive effects, all elements perform at all operating frequencies.

In another preferred embodiment, the radiative elements 20, 22, and 24 have a length of 16 inches, 17¾ inches, and 18¼ inches, respectively, and each is primarily responsive to the above noted frequency bands.

Preferably, the radiative antenna elements do not change in cross-section along their length and have the same generally cylindrical cross-section (i.e., diameter). The radiative antenna elements could differ from one another, depending on the application. For example, the conductive surface areas of the radiative antenna elements could be different. In some applications, the radiative antenna elements could be tapered, in which case the respective lengths are adjusted as appropriate to establish quarter wavelength radiating elements. Additionally, the radiative antenna elements could be of different conductive materials, or have a different electrical length or electrical surface area.

In other applications, the radiative antenna elements may be of the same physical length. The radiative antenna elements could be extendable and retractable to lengthen or shorten the length of any or all of the antenna elements. Additionally, the elements may be coiled.

Figure 5:
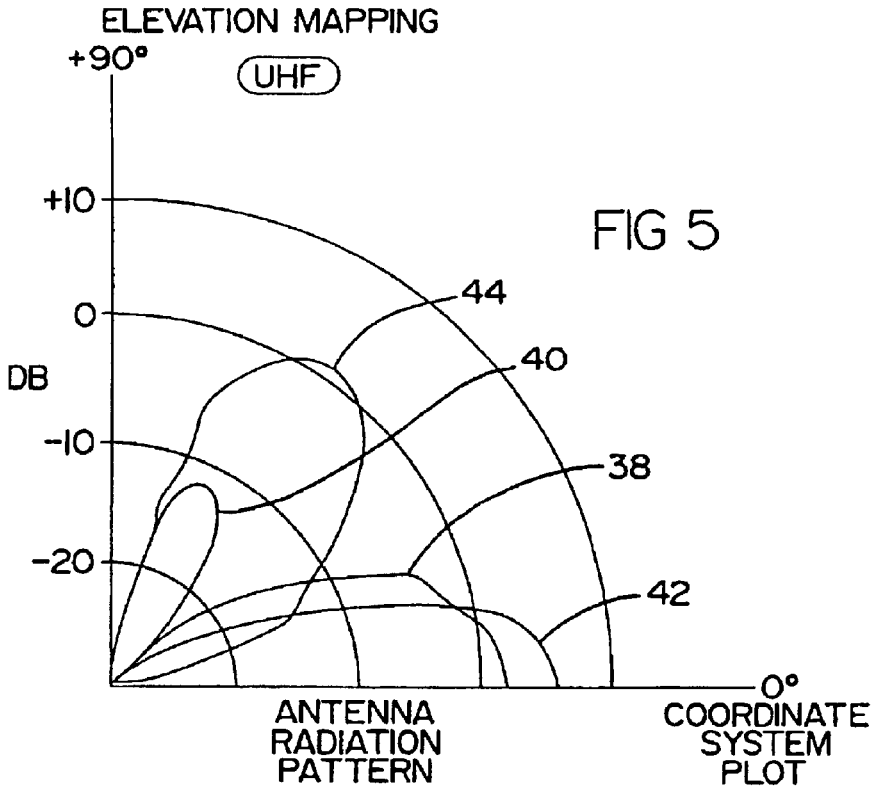
FIG. 5 is a graph comparing the UHF radiation pattern of a ⅝-wave antenna and an antenna according to the present invention.

FIGS. 4 and 5 compare the VHF and UHF antenna radiation patterns of a ⅝ wave antenna with that of the three member antenna 10 of the present invention. The radiation patterns are for a vertically polarized antenna and a dual polarized antenna according to the present invention.

In FIGS. 4 and 5, respectively, the VHF and UHF vertically polarized radiation patterns of a ⅝ wave antenna are shown at 38 and 40 and at 42 for the dual polarized antenna according to the invention. Similarly, the VHF and UHF dual polarized radiation patterns of an antenna of the present invention are shown, respectively, at 44 in FIGS. 4 and 5.

Advantageously, the dual polarized antenna of the present invention is much shorter than a ⅝ wave VHF antenna and a collinear UHF antenna.

The design herein is also applicable, where similar qualities are desirable, to (1) HF (shortwave) applications where wires are used for the elements suspended by non-(electrically) conductive "rope" to towers/poles/trees/buildings; and (2) wireless handheld (phones) radios with a radome for the elements where a convenient "flip-panel" would be needed, depending on operating frequency, for the (horizontal) ground plane; and (3) any portion per design of the RF spectrum with appropriate construction.

In all cases, ideally, the radius of the ground plane which may be at 90° to axis A, or alternatively, at greater angles up to 160° to axis A, is minimally ¼ wavelength of the minimum transceiving frequency. Further, the shortest radiating element is ideally about ⅛ wavelength of the lowest receiving frequency.

Figure 7:
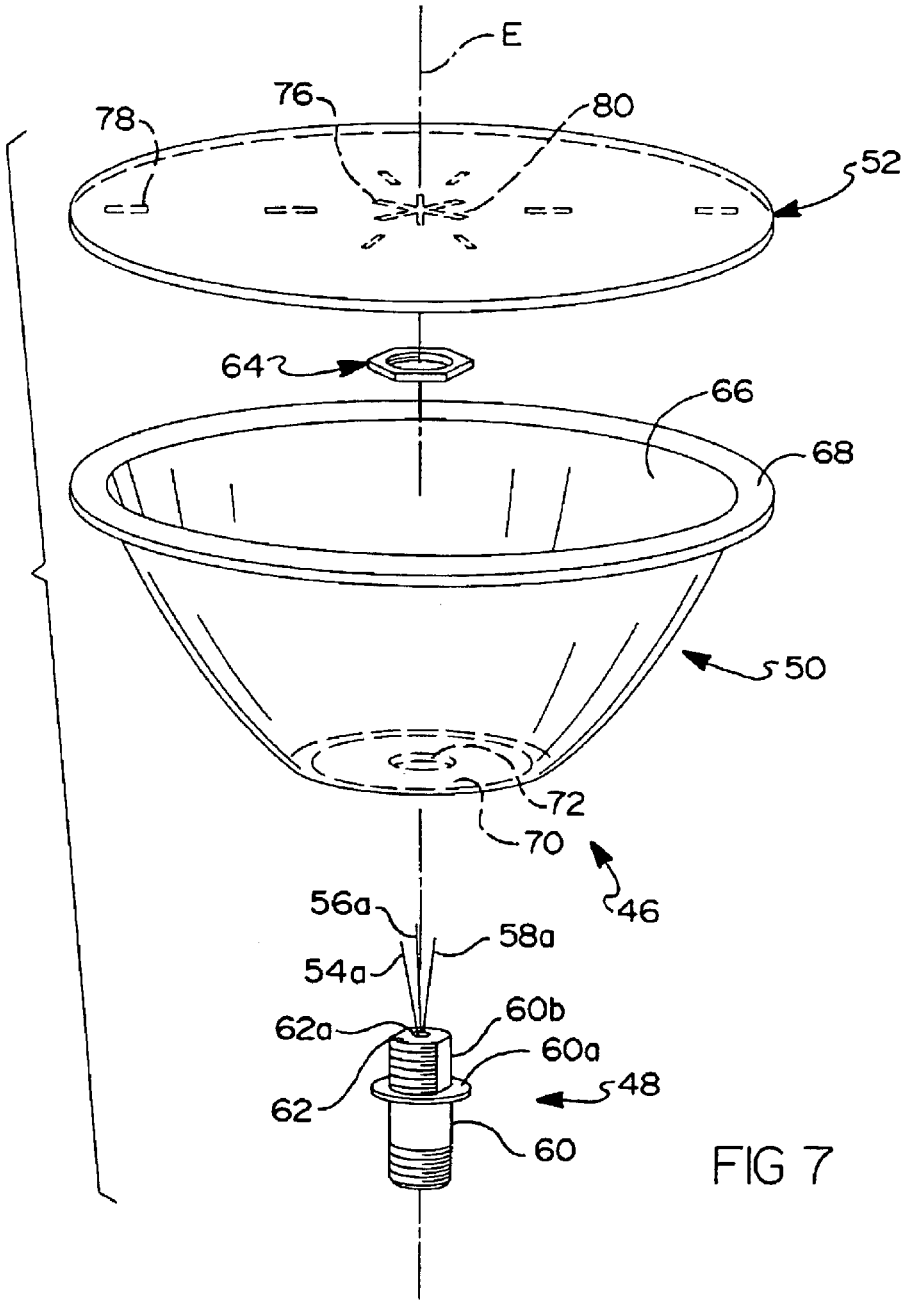
FIG. 7 is an exploded assembly view of a three-element antenna with a parabolic reflector dish and a director plate.

According to another aspect of the invention, a three-element antenna is generally indicated by the number 46. The antenna 46, shown in FIGS. 7–9, comprises a radiative member 48, a truncated parabolic reflector dish 50, and a director plate 52. Generally, the radiative member 48 is the "driven" element of the antenna that is connected to and receives power from the receiver/transmitter. The director plate 52 reinforces radiation on a line to it from the driven element. The truncated parabolic reflector dish 50 reinforces radiation on a line pointing from it to the driven element and is symmetrically disposed about a geometric axis "E".

According to this invention, the radiative member 48 comprises a generally cylindrical connector shell 60, and three radiative elements 54, 56, and 58, each being of an electrically conductive material. Suitable conductive materials were discussed herein above in connection with the elements 20, 22, and 24.

The connector shell 60 is generally hollow and dimensioned to receive a cylindrical body 62 of dielectric material, or other suitable electrically insulative material. The connector shell 60 and the body 62 are generally concentric with one another and about a common geometric axis.

The outer surface of the conductive shell 60 is preferably provided with a medial collar or stop 60*a* to position the radiative member 48 relative to the reflector dish 50. Further, the exterior forward end portion of the conductive shell 60 is provided with thread 60*b* adapted to engage with complementary thread in a hex washer 64 used to mount the shell 60 to the reflector dish 50.

The radiative elements 54, 56, and 58 include, respectively, a forward end portion 54*a*, 56*a*, and 58*a* and a rearward end portion (not shown). The rearward end portions of the radiative elements 54, 56, and 58 are assembled into a bundle that extends coaxially from a point 62*a* centrally of the dielectric material and through the dielectric body 62 for electrical connection to a suitable electrical connector. Typically, the other end of the bundle is further connected to a cable or like interconnection device. The electrical connector and interconnection device are not shown as understood by those skilled in the art.

The forward end portions 54*a*, 56*a*, and 58*a* are generally straight, and extend upwardly and angle outwardly from the common point 62*a* centrally of the dielectric material 62. The end portions 54*a*, 56*a*, and 58*a* form the outline of an imaginary cone, the apex of which is centered at the point 62*a*. The cone is generally symmetrically centered and aligned on the geometric axis of the radiative member 48, as well as with the geometric axis "E" of the reflector dish 50.

The forward end portions 54*a*, 56*a*, and 58*a* of the radiative elements 54, 56, and 58 may be of the same or different length. Preferably, as described herein above, the outward ends of the radiative elements are disposed around the base of the imaginary cone and spaced equiangularly apart by about 120°. However, and depending on the application, the frequency band, or the geometry of the reflector dish (e.g., diameter), the radiative elements may be of different lengths, as described herein above.

FIGS. 6A and 6B illustrate aspects of the parabola, which are known to those skilled in the art. The parabola is a two-dimensional curve generally defined by a mathematical equation (e.g., $Y=a X^2+b$). The parabolic curve has a vertex (the bottom point of the curve) and a focal point, each disposed on the central axis with the focal point being above the vertex.

A paraboloid of revolution is a three-dimensional shape resulting from the curve being rotated 360° about the central axis, referred to in FIG. 6A as the "Y-axis". A paraboloid may be "truncated", either at a "forward end portion" whereby to form a dish having an opening, or aperture plane, or at a bottom location whereby to form a flatted base.

The reflector dish 50 is a truncated paraboloid of revolution, formed of an electrically conductive material, and blocks radiation in an unwanted direction and redirects it in a desired direction. While preferably shown as being solid and of one-piece construction, the reflector dish may also be comprised of a grid or mesh screen, depending on the frequency used and the diameter of the dish. While the reflector dish 50 is preferably comprised of solid stainless steel, the dish may also be of copper, brass, aluminum, bronze, or other conductive materials known by those skilled in the art.

The reflector dish 50 is outwardly open, as defined by a circular end portion 66, has an inner surface 68 of parabolic shape, and a planar flat end wall 70, the portions 66, 68, and 70 of the reflector dish 50 being generally coaxially centered about the common geometric axis "E" of the parabola. The end portion 66 forms an open end of the dish, defined by a diameter "F", and the end wall 70 is defined by a diameter "G", the end wall forming the truncated end of a paraboloid of revolution.

The end wall 70 is in a plane generally perpendicular to the geometric axis "E" of the parabola and has a central opening 72 sized to receive the forward end portion 60*b* of the radiative member 48. So positioned in the opening, the forward end portion is interiorly of the reflector dish 50. Thereafter, the washer 64 is threadably engaged with the thread provided on the forward end portion 60*b*, thereby drawing the collar 60*a* into snug engagement with the exterior surface of the end wall 70.

The parabolic reflector dish 50 is used to achieve high gain (i.e., increase in signal level), modify patterns (i.e., the ability to alter directional gain), be all-polarized, and reduce backward radiation. Gain is a function of parabolic reflector diameter, surface accuracy, and illumination of the reflector by the feed mechanism (focal point). Desirably, a collimated beam of radiation will be produced.

Referring to FIGS. 6A and 6B, by placing an isotropic radiative source exactly at the focus "f" of the parabola, the radiated wave will be reflected from the parabolic surface as a plane wave at the aperture plane. The paraboloid obtains maximum gain and maintains in phase reflective components at the radiative member. Importantly, as is well known, the paraboloid reflector has the important property that it directs parallel rays from different sources onto its focal point; and conversely, it concentrates rays from a source at its focal point into an intense beam parallel to the "x-axis" of the parabola.

When the radiative member 48 is secured by the washer to the end wall 70 of the reflector dish 50, the radiative elements 54*a*, 56*a*, and 58*a* project upwardly from the end wall 70 and into the lower end portion of the dish 50. However, although it is desirable to have the radiative elements located exactly at the focal point of the reflector dish, due to their length and their arrangement into a cone, the elements 55, 56, and 58 cannot be located exactly on the focal point. So positioned, the mid-points of the radiative triple-interactive elements 54*a*, 56*a* and 58*a* are approximately at the focal point of the paraboloid of revolution.

The larger the size of the reflector, to a point, the narrower this lobe becomes. That is, the antenna has narrowed its beam width or increased its gain. In effect, the radiative elements serve to illuminate the reflector and the reflector radiates on transmit and collects on receive.

The end wall 70 serves to create an effective ground plane for the radiative elements, resulting in effective dual lobe/dual polarization radiation which is then additionally directed by the parabolic surfaces and the director rods.

The parabolic reflector operates over an extremely wide range of frequencies, limited at the low end by its diameter "d" and at the high end by its surface accuracy. That is, all parabolic dishes have the same parabolic curvature, but some are shallow dishes, and others are much deeper and shaped more like a bowl. Deep dishes with a low ratio of f/d tend to have a higher efficiency and are more shielded from noise.

A convenient way to describe how much of the parabola is used is the f/d ratio. All dishes with the same f/d ratio require the same feed geometry, in proportion to the diameter of the dish.

Preferably, the f/d ratio is from about 0.15 and 0.625, depending on the configuration of the radiator.

Further, the truncated paraboidal shaped dish antenna may be shallow or deep depending on the opposite ends (or slices) of the paraboloid of revolution. There are three possibilities. First, the paraboloid may be such that the radiative source (i.e., feed) is positioned at the focal point in the dish and below the aperture plane, resulting in "under-illumination". It is difficult to illuminate the dish uniformly with the radiative source so located because waves arriving from opposite directions tend to cancel through superposition. Second, the paraboloid may be such that the radiative source and focal point are well outside the aperture plane, resulting in "over-illumination". Because the feed point is not well shielded, such placement may present problems: an increased chance of receiving unwanted signals and noise and transmission loss, and signals from the feed may miss the edge of the dish. For a feed point at the aperture plane, parabola geometry dictates that ratio of the focal distance to the dish diameter be 0.25

According to one preferred embodiment, the opening 66 and the end wall 70 of the reflector dish 50 are spaced from one-another by about 4½ inches, the wall thickness of the dish 50 is about 1/16 inch, the opening diameter "F" of the dish outer opening 66 (i.e., corresponding to the element "d" of FIGS. 6A and 6B) is about 8⅜ inches, and the diameter "G" of the dish end wall 70 (i.e., corresponding to the truncation line shown on FIG. 6B) is about 4¾ inches. The parabolic wall, if continued from the end wall 70 to the vertex of the completed paraboloid of revolution, is about 1⅛ inch. Antenna elements 54, 56, and 58 are about 1⅛, 13/16, and 1¼ inch and the distance from the end wall 70 to the mid-length (i.e., center) of an antenna element—defining the ideal focal point of the parabola, is about 9/16 inch. The focal point length "f" is about 1¾ inches (i.e., 9/16 inch+1/16 inch+1⅛ inch). Accordingly, for this reflector dish, the f/d ratio is about 0.21 (i.e., 1¾ inch divided by 8⅜ inch).

The director plate 52 comprises a thin, generally circular disk or support member 74, that is transparent to electromagnetic waves, radio waves, and the like, and is fixedly secured to the forward end of the dish 50. Suitable materials are acrylic, PVC (polyvinyl chloride), ABS, and various polymers. The circular disk 74 is generally of a diameter "F", coextensive with the open end 66 whereby to close the open end of the dish, has a geometric center generally coaxially aligned with the geometric axis of the dish 50 when mounted to the end 66, and generally perpendicular to the geometric axis of the dish.

To enable rapid assembly of the director plate 52, the open end of the dish may be provided with an annular flange or lip 51 upon which an outer annular edge portion of the support member 74 is secured. Suitably, securement may be by conventional means, such as an adhesive, epoxy or the like.

Preferably and according to this invention, a plurality of conductive director rods or legs 76 and 78 are secured to the director plate 52 in a predetermined array. In general, the director rods 76 and 78 are axially elongated, and coplanar with one another. The director rods 76 and 78 are spaced a predetermined axial distance from the forward end of the radiative member 48, and the director rods 78 are centered about a line extending from the apex 62*a* of the radiative elements 54, 56, and 58.

Preferably, six conductive director rods 76 are positioned in the center of the support member 74 in a manner to form the spokes of a wagon wheel (e.g., a 6-legged star) or wave director, generally denoted by the number 80. The conductive director rods 76 of the wave director star 80 are aligned with a respective radius extending radially outwardly from a common center that is centered on the geometrical axis of the reflector dish, and are at about 60° to one another. The outward extensions of the director rods 76 are disposed on the circumference of a circle that is concentric with the center of the support member 74.

Further, six conductive director rods 78 are positioned on the support member 74 and in an annular band encircling the wave director star 80. In this arrangement, the annular band is formed by an inner and an outer circle that are concentric with one another and the geometric center of the support member 74. Further, the inner circle of the annular band is spaced from and concentric with the circle defining the outward radial extension of the director rods 76 of the wave director star 80.

The director rods 78 have their opposite ends disposed on the circumference of one and the other of the circles forming the annular band and are aligned with a respective radius extending from the geometric center of the support member 74. Preferably, the director rods 78 are angularly spaced from one another by about 60°.

Further, the director rods 76 of the wave director star 80 are preferably angularly offset from the director rods 78 of the annular band by about 30°.

So positioned, the radioactive element 48, the parabolic reflector dish 50, and the director rods 76 and 78 cooperate to produce a wide band high gain antenna. The director rods 76 and 78 are positioned relative to and coaxially aligned with the radiative member 48 and the three radiative elements 54, 56, and 58 thereof.

In one arrangement, the outer diameter of the support member 74 is about 9⅜ inches, the diameter of the inner and outer circle of the annular band is, respectively, about 3½ and 5½ inches, and the outer diameter of the wave director star 80 is about 1 inch (correlating to ~0.9 of ¼ wavelength at 2.4 GHz.). Each director rod 78 is about 1 inch. The director rods 76 of the wave director star 80 have a radial length of about ½ inch (i.e., the combined diametral length is about 1 inch). The director rods 76 and 78 are thin conductive strips, such as small gauge copper electrical wire, and preferably about 3–4 mm diameter.

So positioned, the respective sets or arrays of director rods 76 and 78 ensure proper phase relationship with the incoming/reflected signal. That is, the director rods 76 and 78 act as parasitic re-radiators, reflecting back to the radiative element 48 any re-radiation therefrom, and as a lens for any incoming radiation.

In general, the director rods 76 and 78 act as amplifiers to an incoming signal. Preferably, the length of each director rod is less than one half of a wavelength, and herein, less than ¼ wavelength.

From the foregoing, it is apparent that the tri-element antenna provides for the reliable accomplishments of the objects of the invention, and does so in a particularly effective and economical manner. It is recognized, of course, that those skilled in the art may make various modifications or additions to the preferred embodiments chosen to illustrate the invention without departing from the spirit and scope of the present contribution to the art. Accordingly, it is to be understood that the protection sought to be afforded hereby should be deemed to extend to the subject matter claimed and all equivalents thereof fairly within the scope of the invention.

What is claimed is:

1. A dual polarization antenna for receiving and transmitting high frequency signals in conjunction with a substantially horizontal ground plane, said antenna comprising:

an electrically conductive first, second and third antenna element to receive horizontally and vertically polarized components and jointly resonate within three separate frequency hands, each said element being axially elongated and having a first end and a second end, and a mounting block comprised of a dielectric material adapted to be mounted to the ground plane, said mounting block electrically insulating said first, second, and third antenna elements from the vehicle ground plane and securing said antenna elements into a triangular arrangement such that said second ends are in electrical circuit path relation with one another and the first ends are spaced vertically upwardly and above said mounting block and circumferentially spaced at 120°, said first, second, and third antenna elements forming an imaginary cone, the center axis of the cone being generally perpendicular to the ground plane, the apex of the cone being formed by the second ends of the elements, and each of the antenna elements being disposed at an acute angle relative to the ground plane.

2. The dual polarization antenna as claimed in claim 1, wherein said radiative elements have a different length to provide horizontal and vertical polarization in each said separate frequency band.

3. The dual polarization antenna as claimed in claim 1, wherein at least one of the radiative elements is extendable and retractible to lengthen or shorten the length of the radiative element to enable the antenna to be responsive to greater frequency bandwidth.

4. The dual polarization antenna as claimed in claim 1, wherein said first radiative element is about 10% longer than said second radiative element and about 10% shorter than said third radiative element.

5. The dual polarization antenna as claimed in claim 1, wherein at least one of the radiative elements may be coiled whereby to lengthen or shorten the length of the radiative element and enable the antenna to be responsive to greater frequency bandwidth.

6. A dual polarization antenna for receiving and transmitting high frequency signals in conjunction with a substantially horizontal conducting panel defining a ground plane, said antenna comprising:

a first, second and third radiative element each comprised of an electrically conductive material, each said radiative element being generally axially elongated and extending between a proximal end and a distal end, the respective axial lengths of the radiative elements being different from one another, and means mountable of the conducting panel for securing the proximal ends together at a common point and in electrical circuit relation with one another for connection to a vehicle transceiver, the radiative elements extending vertically upwardly and outwardly from said common point whereby to form an imaginary cone with the proximal ends forming the apex of the cone, said radiative elements each being disposed at an angle relative to the ground plane to provide horizontal and vertical polarization in a first, second and third frequency band.

7. The antenna as claimed in claim 6, wherein the imaginary cone has a circular base spaced from said apex and said ground plane, and the distal ends of said radiative elements are circumferentially spaced at 120° around said base.

8. The antenna as claimed in claim 7, wherein the imaginary cone has a central geometric axis extending between the apex and the base and the radiative elements forming the cone are disposed at an angle of between 45° to 70° relative to the geometric axis of the cone.

9. The antenna as claimed in claim 6, wherein the length of the first, second and third radiative element is, respectively, about 16¾ inches, 18½ inches, and 19 inches.

10. The antenna as claimed in claim 6, wherein the length of the respective radiative elements causes the antenna to respond to the frequency bands of about 140–170 MHz, 200–225 MHz and 400–480 MHz.

11. An antenna for receiving or transmitting electromagnetic radiation within a predetermined frequency band, the antenna comprising:

a radiative member including three radiative elements for transmitting and receiving said radiation, said radiative elements forming an imaginary cone with the apex of the cone defining a common point whereat one end of each said element is connected, a truncated parabolic reflector, said reflector having a parabolic surface portion conforming to a paraboloid of revolution about a central geometric axis, a focal point, an end wall, and a forward end portion, means for mounting the radiative member to said reflector and positioning said radiative elements substantially at said focal point, and means for supporting and positioning a plurality of conductive director rods in svaced overlying relation to said radiative member, said director rods being substantially coplanar.

12. The antenna as claimed in claim 11, wherein said means for supporting comprises a generally planar support member connected to the opening of said reflector, and said director rods are connected to said support member.

13. The antenna as claimed in claim 12, wherein said plurality of director rods extend radially and comprise a first set and a second set disposed concentrically about the center of said support member and aligned with the radiative member.

14. The antenna as claimed in claim 13, wherein the radiative elements forming said imaginary cone are, respectively, about 1⅛ inch, 1³⁄₁₆ inch, and 1¼ inch long, and the director rods are about one inch long.

15. The antenna as claimed in claim 13, wherein said first set comprises a plurality of rods disposed radially and at 60° to one another, and said second set comprises a plurality of rods disposed in encircling relation and radially outwardly from said first set of rods, the second rods being disposed at 60° to one another, and offset at 30° to a respective pair of first director rods.

16. The antenna as claimed in claim 13, wherein diameters of the forward end and truncated end wall of the parabolic reflector are, respectively, about 8⅜ inches and 4¾ inches, and are separated by about 4⅝ inches.

17. The antenna as claimed in claim 12, wherein said support member is comprised of a material substantially transparent to electromagnetic energy.

18. The antenna as claimed in claim 11, wherein said reflector has an opening defined by a diameter "d" and is defined by a parabola that has a central geometric axis and a focal point "f" located on the axis, the ratio of "f/d" being about 0.01 to about 0.625.

19. The antenna as claimed in claim 18, wherein said "f/d" ratio is about 0.210.

20. The antenna as claimed in claim 19, wherein the "f/d" ratio of 0.21 is with the proximal ends of the tn-element antenna disposed at the center of truncation of the parabola.

21. The antenna as claimed in claim 18, wherein the midpoint of the axially elongated radiative elements is substantially at the focal point of the reflective dish.

22. An antenna for receiving or transmitting electromagnetic radiation within a predetermined frequency band, the antenna comprising:

a radiative member including three radiative elements for transmitting and receiving said radiation, said radiative elements forming an imaginary cone with the apex of the cone defining a common point whereat one end of each said element is connected, a truncated parabolic reflector, said reflector having a parabolic surface portion conforming to a paraboloid of revolution about a central geometric axis, a focal point, an end wall, and a forward end portion, means for mounting the radiative member to said reflector and positioning said radiative elements substantially at said focal point, and a generally planar support member for supporting and positioning a plurality of conductive director rods in spaced overlying centered relation above said radiative member, said director rods being in generally coplanar relation and including first and second sets of director rods, the first set of director rods being arranged to form the spokes of a wheel and the second set of director rods extending radially and disposed in an annular band spaced in encircling relation to the first set of director rods, the center of the wheel and the annular band being centered on a vertical axis extending through the geometric center of the support member and the radiative member, and the second set of director rods being equiangularly spaced to one another and offset with a respective pair of director rods of said first set of director rods.

23. The antenna as claimed in claim 22, wherein said director rods are of substantially the same length, and the director rods of said first array have their respective midpoints located on the geometric axis.

24. An antenna for receiving or transmitting electromagnetic radiation within a predetermined frequency band, the antenna comprising:

a truncated parabolic reflector, said reflector having a parabolic surface portion conforming to a paraboloid of revolution about a central geometric axis, a focal point, an end wall forming a ground plane, a forward end defining an opening, and a forward end portion between said focal point and said forward end, three radiative elements for transmitting and receiving said radiation, said radiative elements being straight, having opposite ends, and of substantially the same length, said radiative elements being arranged to form a cone, wherein one end of said radiative elements is connected at a common point and in electrical circuit relation to said ground plane and the other end of said radiative elements angle outwardly from the common point, means for mounting the radiative elements to said parabolic reflector and positioning said radiative elements substantially at said focal point, and a plurality of conductive director rods in spaced overlying relation to said radiative member.

25. The antenna as claimed in claim 24, wherein said director rods form a first and a second array, the second array encircling the first array.

26. The antenna as claimed in claim 25, wherein said director rods are substantially coplanar, and said radiative elements and the director rods of said second array are about the same length.

27. The antenna as claimed in claim 25, wherein the director rods of said first array are arranged to form the spokes of a wheel having a center and the director rods of said second array are disposed in an annular band spaced in concentric encircling relation about the first array, the wheel center is located on the geometric axis of the reflector, the director rods of each said array are disposed on a radius from the center, and successive pairs of director rods in the annular band are equiangularly offset, respectively, from successive pairs of director rods of the wheel.

28. The antenna as claimed in claim 27 wherein the director rods in each respective array are spaced at 60° to one another, and the rods of the wheel are offset 30° to the rods of the annular band.

29. The antenna as claimed in claim 26, further comprising a generally planar support member of electromagnetically transparent material covering the opening of said reflector, wherein said support member has a center located on the geometric axis of said reflector and said director rods are connected to said support member.

30. The antenna as claimed in claim 24, wherein the opening of said said reflector is defined by a diameter "d", and said reflector is defined by a paraboloid of revolution and the focal point "f" is located on the axis, and wherein the ratio of "f/d" is about 0.01 to about 0.625.

31. The antenna as claimed in claim 30, wherein the ratio of "f/d" is about 0.210.

32. The antenna as claimed in claim 24, wherein the midpoint of each elongated radiative element is substantially at the focal point of the reflective dish.

* * * * *